US005096371A

United States Patent [19]

Mojden et al.

[11] Patent Number: 5,096,371

[45] Date of Patent: Mar. 17, 1992

[54] CARTON FEEDING APPARATUS

[75] Inventors: Daniel R. Mojden, Clarendon Hills; Richard P. Hoinacki, Chicago, both of Ill.

[73] Assignee: Fleetwood Systems, Inc., Countryside, Ill.

[21] Appl. No.: 511,396

[22] Filed: Apr. 17, 1990

[51] Int. Cl.[5] ..... B65G 61/00

[52] U.S. Cl. ..... 414/795.8; 221/11; 271/157

[58] Field of Search ..... 221/11; 414/795.8, 416, 414/417; 271/157

[56] References Cited

U.S. PATENT DOCUMENTS

| | | | |
|---|---|---|---|
| 3,722,741 | 3/1973 | Mojden | 221/11 |
| 4,000,709 | 1/1977 | Mojden | 113/114 |
| 4,526,501 | 7/1985 | Blumle | 414/795.8 X |
| 4,592,462 | 6/1986 | Mojden et al. | 198/464.2 |
| 4,907,941 | 3/1990 | Focke et al. | 414/609 X |

FOREIGN PATENT DOCUMENTS

| | | | |
|---|---|---|---|
| 2023107 | 12/1979 | United Kingdom | 414/795.8 |

*Primary Examiner*—Robert J. Spar
*Assistant Examiner*—Janice Krizek
*Attorney, Agent, or Firm*—Trexler, Bushnell, Giangiorgi & Blackstone, Ltd.

[57] ABSTRACT

A carton feeding apparatus delivers a stack of cartons from a supply thereof in a supply pocket located such that the bottom of the stack of cartons carried therein is at a first vertical level relative to a receiving conveyor located such that the bottom of a stack of cartons received thereby is located at a second vertical level higher than the first vertical level. The apparatus comprises outfeed apparatus located for delivering cartons to the conveyor and loader apparatus movable between a first position in registry with the supply pocket and a second position in registry with the outfeed apparatus for transporting a stack of cartons therebetween. A lift apparatus is provided for lifting a stack of cartons from the supply pocket to the loader apparatus. A transfer apparatus is provided for transferring a stack of cartons from the loader apparatus to the outfeed apparatus. Controls are provided for controlling a predetermined sequence of operation wherein successive stacks of cartons are initially lifted from the supply pocket to the loader apparatus and thereafter transferred from the loader apparatus to the outfeed apparatus at a rate sufficient to assure a continuous supply of cartons to the conveyor.

18 Claims, 8 Drawing Sheets

CARTON FEEDING APPARATUS

BACKGROUND OF THE INVENTION

This invention relates generally to carton feeding apparatus for providing a continuous supply of articles such as collapsed or folded cartons or carton blanks to a utilization device or apparatus.

Modern fabricating, processing and filling equipment operates at relatively high rates of speed in order to attain commercially economical production costs. To operate at these speeds, the processing equipment must be provided with a reliable and continuous supply of articles to be processed. Accordingly, specialized equipment sometimes called "feeding" or "infeeding" equipment, has been devised to meet this need.

One particularly successful type of infeed device is a so-called carousel-type feeder, such as those described and claimed in U.S. Pat. Nos. 3,722,741 and 4,000,709. A carousel-type feeder for carton blanks is also more particularly described and claimed in U.S. Pat. No. 4,592,462.

The carousel-type feeders shown and described in the foregoing patents present a supply of can ends or cartons, as the case may be, to utilization equipment where, for example, can ends are attached to a can body, or the collapsed carton blanks are erected and filled with a desired product. The equipment can be easily adapted to handle a wide array of stackable products or parts, such as metal, plastic or paperboard lids, tubs, stampings or box flats.

The use of such carousel feed units with carton blanks requires somewhat more careful handling than for typical metal parts such as can ends. For example, it is important to carefully handle the stacked carton blanks so that the edges will not become damaged, bent or frayed during handling. This handling involves a transfer from the supply pockets or chambers of the infeed carousel apparatus to a receiving pocket or chamber or other intake device of the supply means for the processing machinery.

The above-mentioned U.S. Pat. No. 4,592,462 discloses and claims means for overcoming most of these problems However, there is room for further improvement. In typical carton filling apparatus, a supply of product is brought into the filling apparatus on one line and a supply of the collapsed or folded carton blanks is brought in generally from above the article or product infeed line on a relatively large disc- or wheel-like rotary infeed device. Generally speaking, the blanks are supplied to the rotary infeed device from a conveyor belt. As such, the conveyor belt is located a substantially vertical distance above the product infeed line and hence, an even greater distance above the factory floor.

The carousel-type feeder unit according to the aforementioned '462 patent, requires that the articles be transferred to the conveyor vertically downwardly from a bottom discharge end of a so-called pocket which contains a stack of the carton blanks. This, then, requires that the carousel-type rotary infeed device be physically located at a point such that its bottom or discharge area is vertically above the carton blank intake conveyor belt. The foregoing arrangement requires a relatively high overhead space on the factory floor. Moreover, it requires that the carousel-type device be mounted on an elevated platform, well above the article feed and packaging line, and consequently well above the factory floor. This in turn requires that an operator for the carousel feed device be stationed on the platform. In general, the primary task of the operator is to visually assure proper operation of the carousel infeed device, and more particularly to keep a plurality of supply pockets which rotate thereabout filled with carton blanks.

As such, the operator will be unable to monitor any other part of the processing equipment, thus leading to the need for additional operators for the other associated equipment and increasing labor costs of operation of the product filling line.

OBJECTS AND SUMMARY OF THE INVENTION

It is a general object of the invention to provide a novel carton-feeding apparatus for delivering stacked carton blanks from an outfeed or supply pocket of a carousel infeed device, to an elevated intake of a product filling line while permitting the carousel feed unit to remain on the factory floor for easy access by the operator Briefly, and in accordance with the foregoing object, a carton feeding apparatus for delivering a stack of collapsed cartons from a supply thereof in a supply pocket located such that the bottom of the stack of cartons carried therein is at a first vertical level to a receiving conveyor located such that the bottom of a stack of cartons to be received thereby is located at a second vertical level higher than said first vertical level, comprises outfeed means located for delivering cartons to said conveyor; loader means movable between a first position in registry with said supply pocket and a second position in registry with said outfeed means for transporting a stack of cartons therebetween; lift means for lifting a stack of cartons from said supply pocket to said loader means; transfer means for transferring a stack of cartons from said loader means to said outfeed means, and control means for controlling a predetermined sequence of operation wherein successive stacks of cartons are initially lifted from said supply pocket to said loader means and thereafter transferred from said loader means to said outfeed means at a rate sufficient to assure a continuous supply of cartons to said conveyor.

BRIEF DESCRIPTION OF THE DRAWINGS

The features of the present invention which are believed to be novel are set forth with particularity in the appended claims. The organization and manner of operation of the invention, together with further objects and advantages thereof may best be understood by reference to the following description, taken in connection with the accompanying drawing in which like reference numerals identify like elements, and in which:

DETAILED DESCRIPTION OF THE ILLUSTRATED EMBODIMENT

Figure 1:
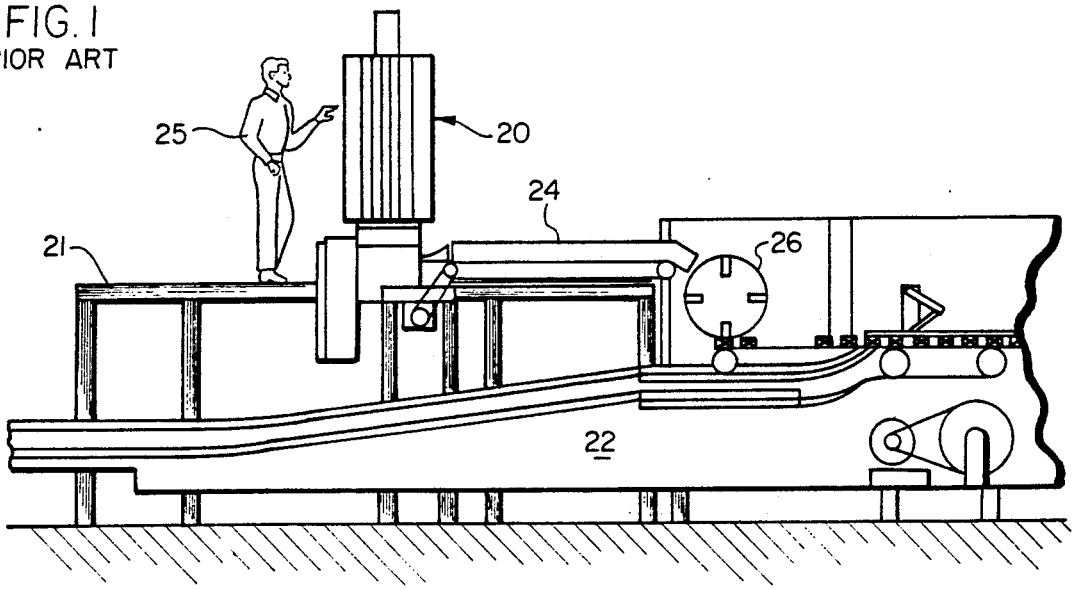
FIG. 1 PRIOR ART
FIG. 1 is a side elevation of a carton-utilization or product-filling line in connection with carton infeed apparatus in accordance with the prior art.

Referring now to the drawings and initially to FIG. 1, a carton filling line or system 22, which uses a carousel-type infeed device 20, both in accordance with the prior art is shown in diagrammatic form. In this prior art system, it will be noted that the carousel infeed device is mounted on a raised platform 21 so that cartons may be fed from a bottom exit portion thereof onto an infeed conveyor 24 of the carton filling line or system 22. This conveyor 24 feeds cartons to an orbital carton feed which comprises a wheel- or drum-like device indicated diagrammatically at reference numeral 26. An operator, as diagrammatically illustrated at 25 must stand upon the platform 21 in order to operate, and in particular to refill the supply pockets of, the carousel-type infeed device 20. Generally speaking, the carousel-type infeed is of the type illustrated and described in U.S. Pat. No. 4,592,462.

Figure 2:
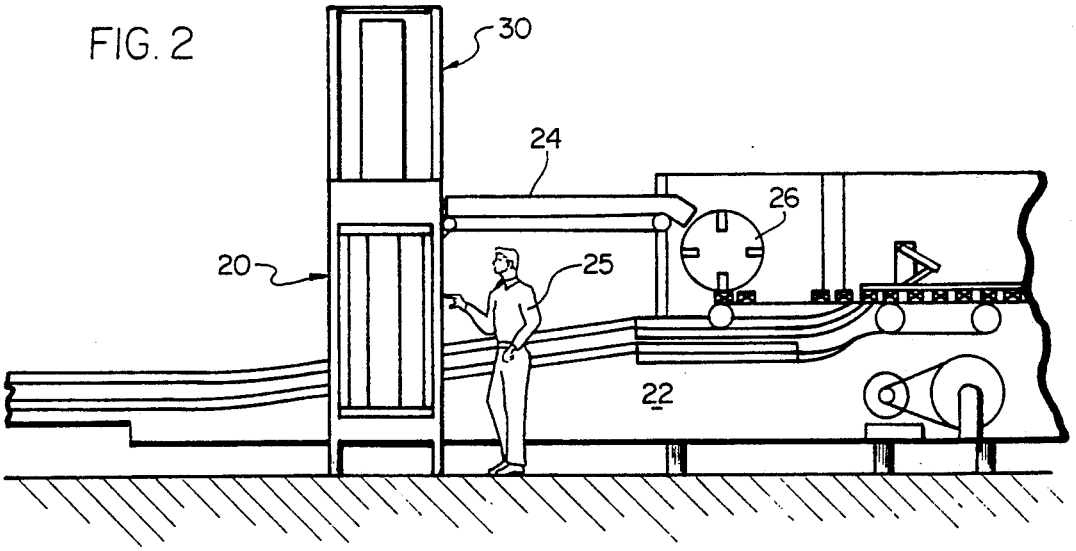
FIG. 2 is a side elevation of a product-filling line similar to that in FIG. 1, in connection with a carton feeding apparatus in accordance with the present invention.
Figure 3:
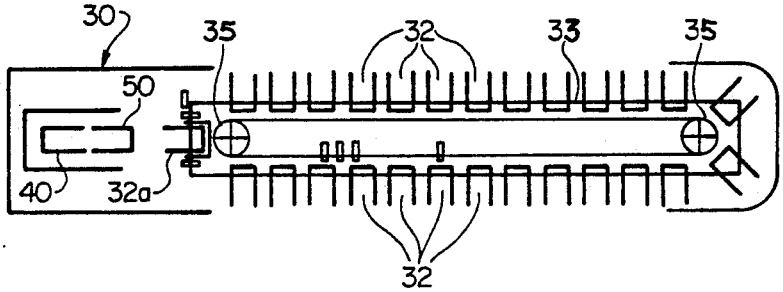
FIG. 3 is a diagrammatic plan view of the apparatus of the invention.

Departing from the prior art, and referring now to FIGS. 2 and 3, the present invention provides a carton feeding apparatus indicated generally by reference numeral 30, which permits feeding of cartons from the carousel-type infeed 20 to the input conveyor 24 without requiring that the carousel infeed 20 be mounted to an elevated platform 21, as in the prior art system of FIG. 1. The operator 25 can remain stationed on the factory floor and be available to oversee operation not only of the carousel infeed device 20, but also of other portions of the line or system 22 as well.

FIG. 3 shows an overhead or top plan view, also diagrammatic in form, of the carousel-type infeed apparatus 20 and of a carton feeding apparatus 30 in accordance with the invention.

The present invention contemplates that the carton feeding apparatus 30 will operate in connection with a carousel-type feeder, substantially of the type shown and described in the above-referenced U.S. Pat. No. 4,592,462; and further details of the carousel-type feeder need not be described herein. However, and departing from what is shown and illustrated in the above-referenced U.S. patent, the carousel-type feeder 20 utilized with the present invention, does not use an ejector mechanism of the type described in the '462 patent.

Generally speaking, the carousel feed includes a plurality of supply pockets or containers 32 which are rotated about a frame 33 by a suitable drive means or mechanism 35. As a given supply pocket 32 reaches an endmost or discharge position, such as the pocket 32*a* in FIG. 3, the articles or cartons therefrom are discharged into the carton feeding apparatus 30 in accordance with the invention.

Figure 4:
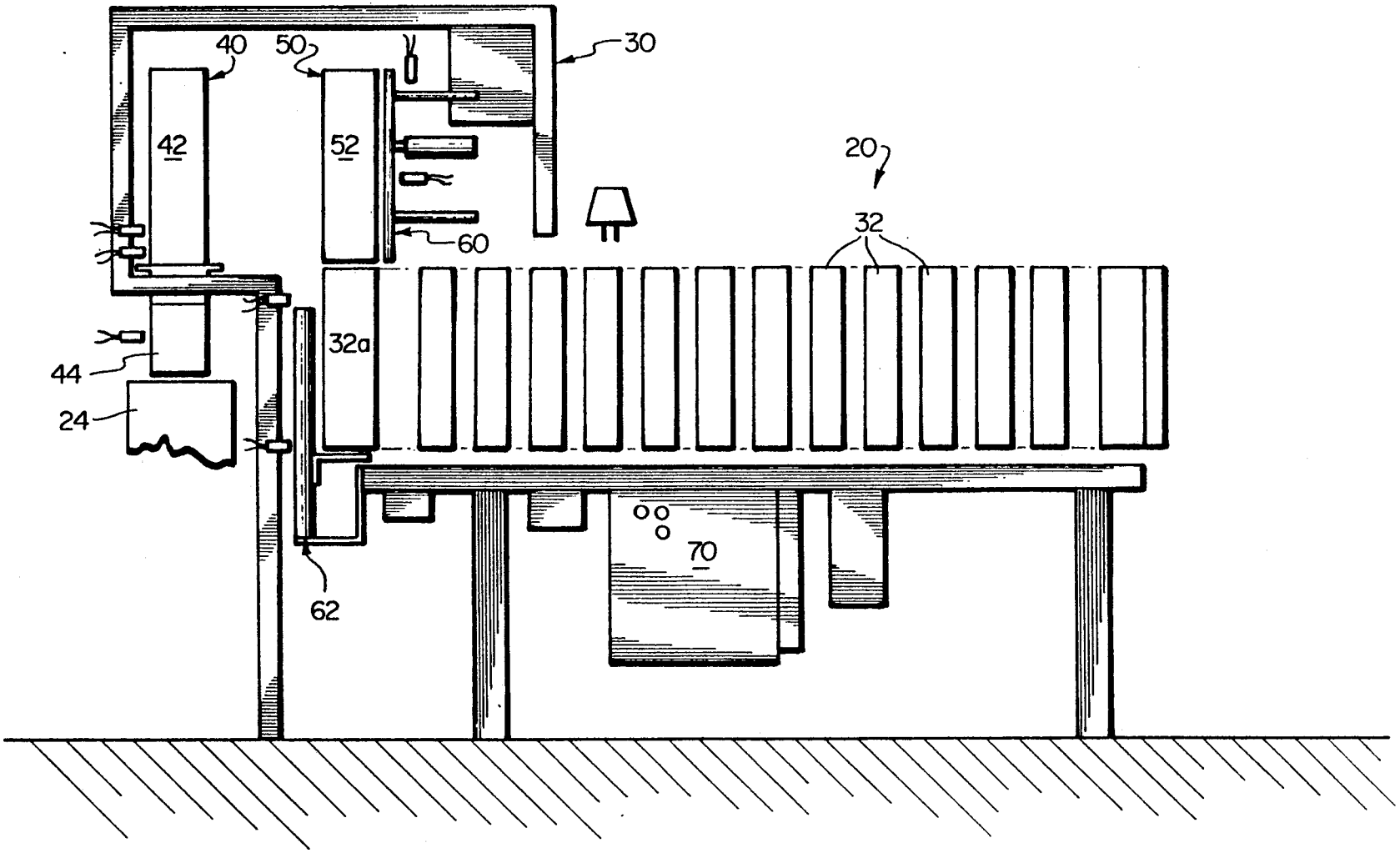
FIG. 4 is a diagrammatic side elevation of the apparatus of the invention.

Referring also to FIG. 4, and departing from what is shown in the above-mentioned '462 patent, carton feeding apparatus 30 includes outfeed means 40 which is located in registry with the conveyor 24 for delivering cartons thereto In the illustrated embodiment, the outfeed means 40 includes a stationary outfeed pocket 42, which is located directly above conveyor 24 for delivering a stack 45 of cartons thereto essentially by gravity feed, through an open outlet end or chute 44.

Figure 6:
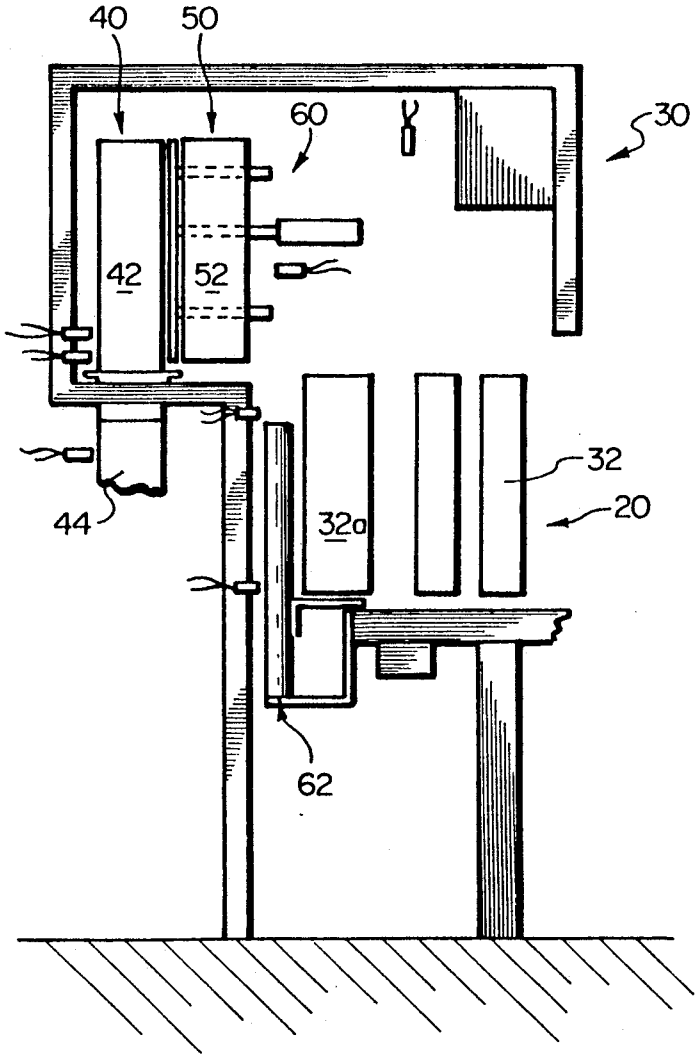
FIG. 6 is a partial view similar to FIGS. 4 and 5, showing a further moved position of the apparatus.
Figure 5:
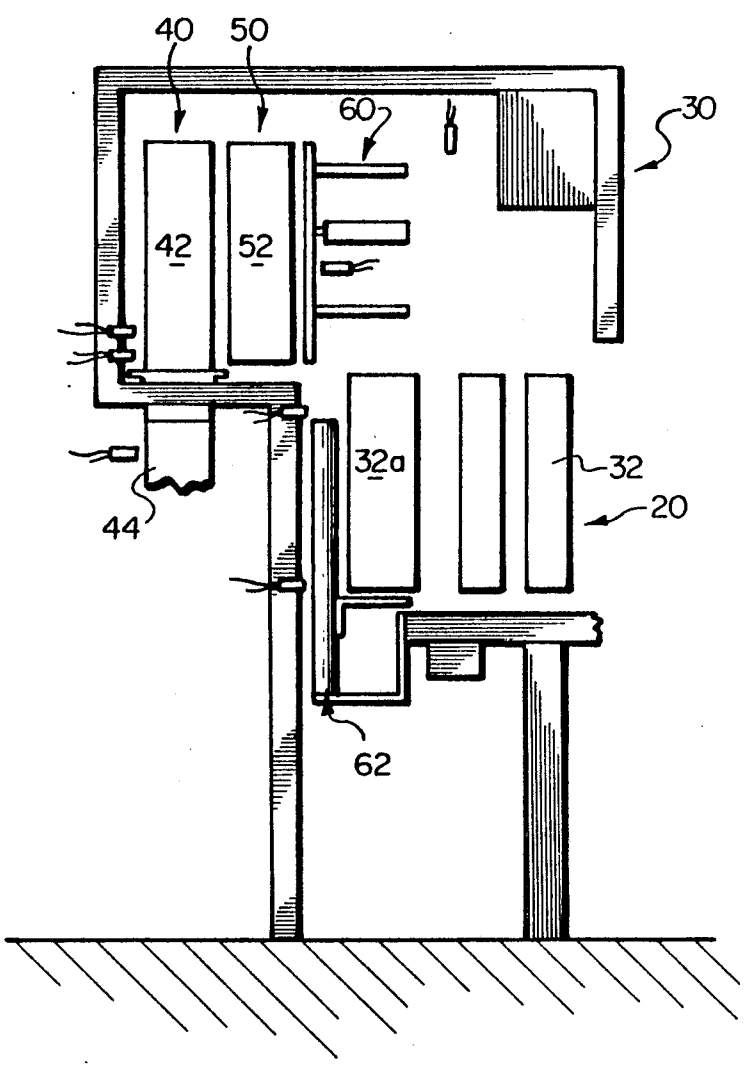
FIG. 5 is a partial view similar to FIG. 4, showing a moved position of the apparatus.
Figure 7:
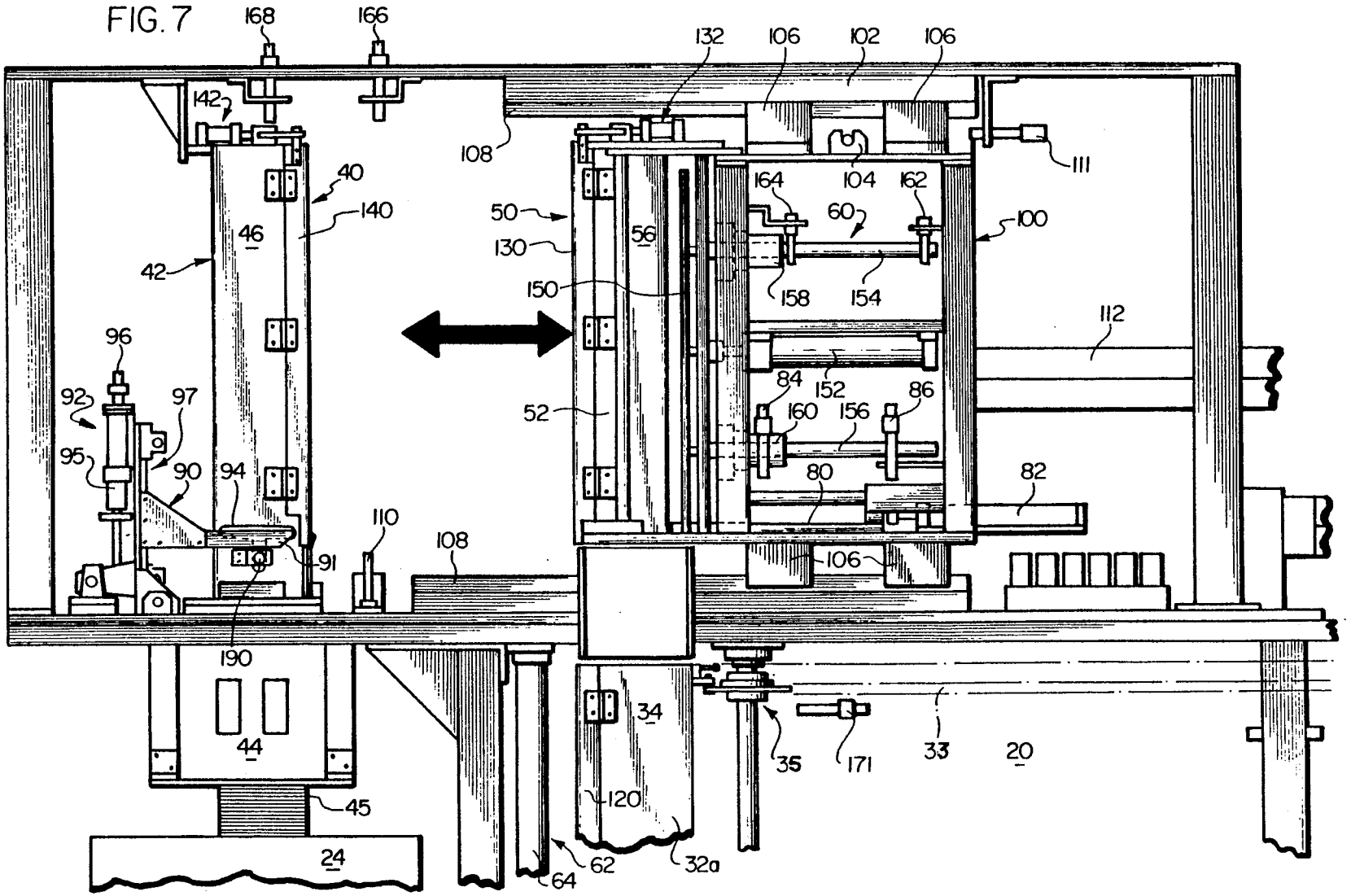
FIG. 7 is a partial side assembly view of apparatus in accordance with the invention.
Figure 8:
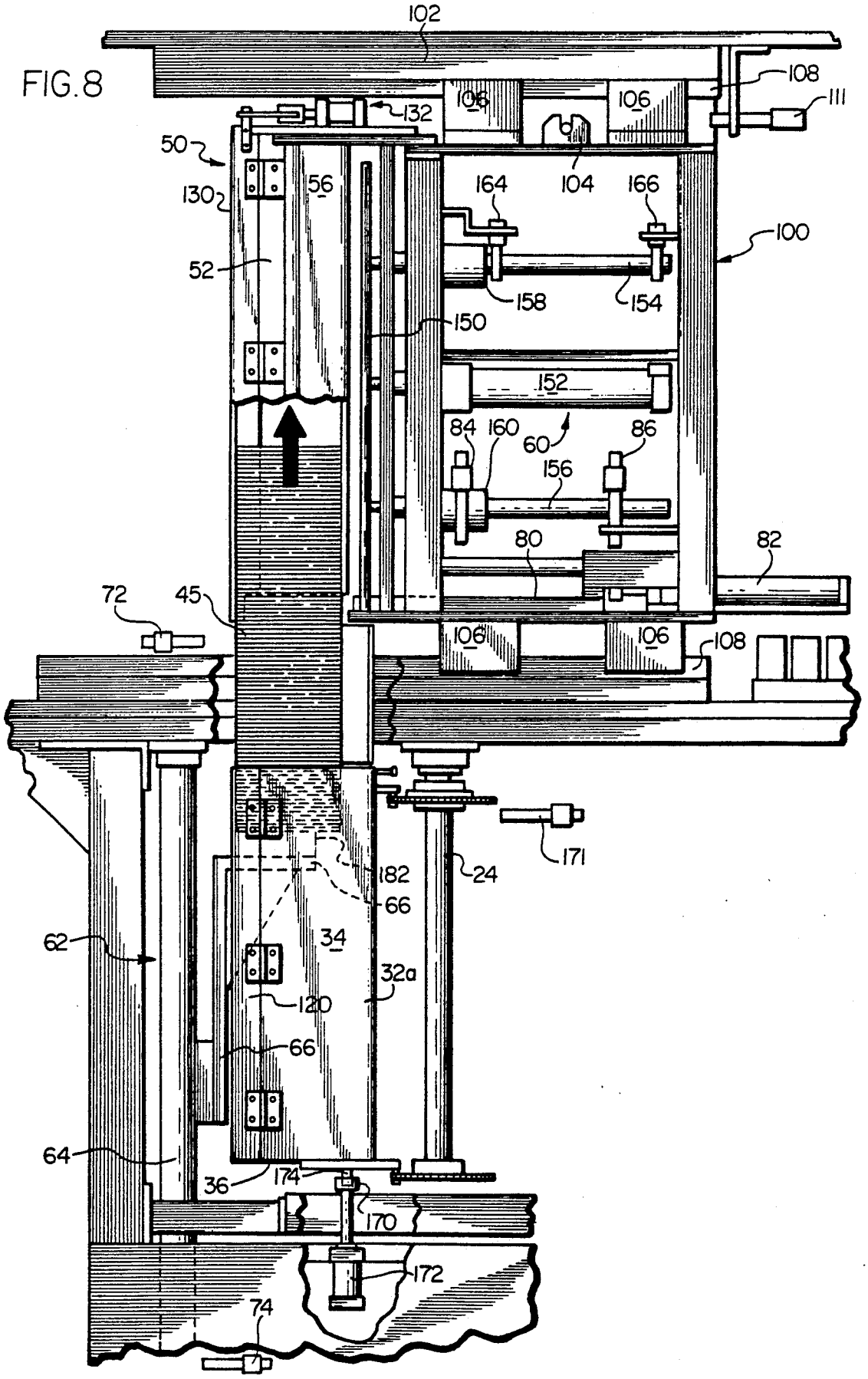
FIG. 8 is a partial, side elevation of the apparatus of FIG. 7, showing a moved position thereof.

Loader means 50 are movable between a first position in registry with the supply pocket 32*a* and a second position in registry with the outfeed means 40 for transporting stacks of cartons therebetween. Referring briefly to FIGS. 5 and 6, the position of the loader means in registry with the outfeed means is illustrated. Transfer means 60 similar to the ejector mechanism illustrated and described in the above-mentioned '462 patent is associated with the loader means for transferring a stack of cartons therefrom into the outfeed pocket 42 of the outfeed means 40. In this regard the loader means includes a loader pocket 52 which is similar in form to both the outfeed pocket 42 and the supply pockets 32 of the carousel feeder device 20, such that each of these pockets accommodates a stack of cartons of the same dimensions. In a preferred form of the invention, the respective pockets 32, 42 and 52 may also be readily removed and pockets of different dimensions substituted to accommodate cartons or other articles of different dimensions, while requiring but minimum shut-down time of an associated line to accomplish the changeover.

In accordance with the invention, lift means 63 are provided for lifting a stack of cartons from the supply pocket 32*a* to the loader pocket 52 of the loader means 50 when the same is in position in registry with the supply pocket as illustrated in FIG. 4. The transfer means 60 will then be activated when the loader means is moved into registry with the outfeed pocket, as illustrated in FIGS. 5 and 6 respectively, to transfer the cartons therebetween. A control apparatus or control means diagrammatically illustrated at 70 employs a number of strategically placed sensors as will be described more fully hereinbelow, to control a predetermined sequence of operation of parts of the feeding apparatus or transfer apparatus 30 thus far described. This sequence of operation is such that successive stacks of cartons are initially lifted from a supply pocket 32 to the loader means 50 and are thereafter transferred from the loader means 50 to the outfeed means 40 at a rate sufficient to assure a continuous supply of cartons to the conveyor 24. Referring also to the remaining figures, it will be seen that the supply pocket 32*a* comprises an elongate, vertically-oriented, open-topped container having sidewalls 34 and a bottom 36 which define a cross-sectional configuration complementary with that of a stack of collapsed cartons or blanks to be accommodated thereby. Openings are defined in the sidewalls 34 and preferably at an end portion thereof which faces outwardly relative to the carousel-type feed unit, andin the bottom 36 for permitting entry and passage of the lift means 62 vertically therethrough for engaging and lifting a stack of cartons upwardly therethrough and into the loader pocket 52 when the same is in alignment or registry therewith directly thereabove. The lift means 62 comprises an elongate, generally vertically-oriented cylinder 64 which is in a generally parallel alignment with the vertical axis or dimension of the supply pocket 32*a*.

An outwardly extending lift arm or member 66, which is coupled for bidirectional vertical movement by the cylinder 64 extends outwardly for entry into and through the openings formed in the bottom 36 and front walls of the supply pocket 32*a* to enter the same and engage and lift the stack of cartons therein, in response to a predetermined control signal from the control means 70. Sensors are provided, preferably in the form of photoelectric eye or optical sensors 72, 74 for sensing when the lift arm 66 is in its fully up and fully down positions respectively relative to the lift cylinder 64, and for providing corresponding sensor signals for use by the control means 70 in controlling the sequence of operation.

The loader pocket 52 is of similar configuration to the just described supply pocket 32*a*. That is, the loader pocket is an elongate, vertically-oriented, open-ended member having sidewalls 56 which define a cross-sectional interior configuration complementary with the stack of collapsed cartons to be received and carried therein. However, it will be appreciated that the bottom wall of the loader pocket is completely open to allow for the free passage of cartons carried upon the lift means or lift assembly 62 from the supply pocket 32*a* therebelow. The loader means also includes a retractable loader shelf means 80 which is movable into and out of the interior of the loader pocket 52 for selectively underlying and supporting a stack of cartons therein. In the illustrated embodiment, the loader shelf is actuated by an actuator means in the form of a bidirectionally operating cylinder 82 which is located generally behind the loader pocket 52 with respect to its direction of movement as it moves into registry with the outfeed pocket 42.

The shelf actuator or cylinder 82 is responsive to a control signal from the control means 70 for moving the loader shelf 80 into and out of position for supporting cartons in the loader pocket 52. In this regard, additional position sensors 84 and 86 are provided for detecting the advanced and retracted positions respectively of the loader shelf 80 with respect to the loader pocket 52. These sensors 84, 86 also preferably take the form of photoelectric sensors, and provide corresponding shelf position signals for use by the controller 70 in controlling the sequence of operation.

Referring briefly to the outfeed pocket 42, in similar fashion to loader pocket 52 and supply pocket 32*a*, the outfeed pocket is also an elongate, vertically-oriented open-ended member. Sidewalls 46 of the outfeed pocket also define an interior cross-sectional configuration complementary with a stack of collapsed cartons to be accommodated thereby. As with the loader pocket 52, the outfeed pocket 42 has an open bottom for permitting the direct transfer of cartons to the conveyor 24 therebelow through outlet chute 44, preferably by gravity feed. In similar fashion to the loader pocket 52, the outfeed means includes a similar outfeed shelf means designated generally by reference numeral 90 which is movable into and out of the interior of the outfeed pocket for selectively underlying and supporting a stack of cartons therein. Shelf actuator means 92 are operatively coupled with the outfeed shelf means and are responsive to a control signal from control means 70 for moving the outfeed shelf into and out of position for supporting cartons in the outfeed pocket 42.

In somewhat different fashion from the shelf 80 associated with the loader pocket, the outfeed shelf means 90 comprises two similar shelf members 91, 93 which enter and exit the outfeed pocket 42 by way of through openings 94 provided at opposite sides thereof. The actuator mechanism 92 for the shelf means 90 comprises a cylinder 95 and a linkage assembly 97. This mechanism is provided with a sensor 96, also preferably in the form of a photoelectric sensor, for sensing whether the actuator is in one of two positions which correspond respectively to the associated shelf members being either projected into the outfeed pocket or being retracted therefrom, respectively. The sensors produce corresponding sensor signals for use by the controller 70 in controlling the sequence of operation.

In order to transport the loader pocket 52 between its respective positions in registry with the supply pocket 32*a* on the one hand and the outfeed pocket 42 on the other hand, the loader means further includes carriage means 100. Carriage means 100 is a frame-like member upon which is mounted the loader pocket 52 and its associated transfer means or ejector mechanism 60, shelf means 80 and cylinder 82, as well as the associated sensors for movement in unison between positions wherein the loader pocket is in registry with the supply pocket and with the outfeed pocket respectively. The carriage is movable bidirectionally to achieve this corresponding movement of the loader pocket. A carriage actuator means is provided in the form of an elongate drive cylinder 102 which is coupled with the carriage 100 by means of a yoke 104 for bidirectionally driving the same. The actuator cylinder 102 is responsive to control signals from the control means 70 for selectively actuating the carriage for movement of the loader pocket between its two respective positions. It will be seen that the carriage includes sliding block members 106 at bottom and top margins thereof which ride along corresponding guide rails or bars 108 to achieve this bidirectional motion. One or more additional position sensors 110, 111 also preferably in the form of photoelectric sensors, are provided for determining the position of the loader pocket 52 and of the carriage 100. Additional control cabling and hydraulic or pneumatic tubing for the various elements mounted to the carriage 100 are carried in an elongate, articulated housing 112 coupled at its end with the carriage 100.

Referring to further details of the respective pockets 32, 42 and 52, each is provided with hingedly movable door means defining one of the sidewalls thereof. Door means 120 of supply pockets 32 are spring-loaded (not shown) to be manually opened and closed by the operator for resupplying the pocket with cartons when each pocket is empty and in a position other than its endmost or unloading position relative to the carousel feed apparatus 20. Similar hingedly movable door means 130 define one sidewall of the loader pocket 52 and are provided with a door actuator means or assembly 132 which is responsive to control signals from the control means 70 for operating the door means 130 between open and closed positions relative to the loader pocket. Similarly, hingedly movable door means 140 of the outfeed pocket are provided with door actuator means 142 responsive to control signals from the control means 70 for operating the doors 140 between open and closed positions relative to the outfeed pocket when the loader pocket and outfeed pocket are located adjacent and in registry with one another as indicated in FIG. 5.

In operation, the transfer means 60 is actuated in a controlled sequence with the respective doors 140 and 150 and outfeed shelf means 90 to effect a transfer of cartons from the loader pocket to the outfeed pocket. In this regard, the transfer means or assembly 60 includes an elongate, vertically-oriented pusher bar means or member 150 in registry with an elongate through opening in a rear sidewall of the loader pocket 52 for entering the same and engaging the stack of cartons therein to push the same outwardly and in the direction of the outfeed pocket 42. A pusher bar actuator 152 in the form of a hydraulically or pneumatically activated cylinder is operably coupled with the pusher bar for bidirectionally moving the same in response to a control signal from the control means 70.

The pusher bar also rides upon a support mechanism including a pair of elongate rod-like rails or slides 154, 156 and complementary through-bored guide members or blocks 158, 160 which slide bidirectionally thereupon. Additional photosensors 162 and 164 are preferably provided for determining the position of the pusher bar 150, and providing suitable signals for use by the control means 70 in connection therewith. Additional photosensors 166 and 168 are also provided for determing the open and closed positions of the respective doors 130 and 140 of the loader pocket and outfeed pocket and providing suitable corresponding signals for use by control means 70.

In accordance with the invention, the control means 70 employs sequencing means for controlling the operations of all of the above-described portions of the transfer apparatus or carton-feeding apparatus of the invention in accordance with a predetermined sequence of operation. Initially, the control means 70 awaits the arrival of a supply pocket 32 at the unloading position or station as illustrated for the supply pocket 32*a*. Thereupon, an additional photosensor 171 is preferably employed to verify that the supply pocket so-positioned is filled with cartons. In the event cartons are not detected, the carousel drive mechanism is again activated to index a next succeeding supply pocket into position. This operation is repeated until a filled supply pocket is encountered. It may occur, from time to time, that the operator will neglect or skip the filling of one or more supply pockets during operation, for example, while other maintenance tasks are being performed.

Upon sensing a filled supply pocket at the outfeed position, the control system actuates an additional stabilizer mechanism which comprises a fork-like gripping member 170, operated by a cylinder 172 to advance and retract relative to a stabilizer rod or stud 174 which extends outwardly from the bottom of the supply pocket 32*a*. The sensor 110 verifies that the loader pocket is in position to accept a load of cartons from the supply pocket, sensor 86 verifies that shelf 80 is withdrawn, and sensor 74 verifies that the lift arm 66 is in its fully retracted or "down" position. The lift cylinder 64 is then actuated to move the lift member into engagement with cartons for lifting the same upwardly out of the supply pocket and into the loader pocket 52. When the lift member has reached its opposite extreme, or "up" position, as verified by sensor 72, the shelf cylinder 82 is actuated. Sensor 84 will indicate when shelf 80 is in the carton-supporting position.

Figures 9, 10:
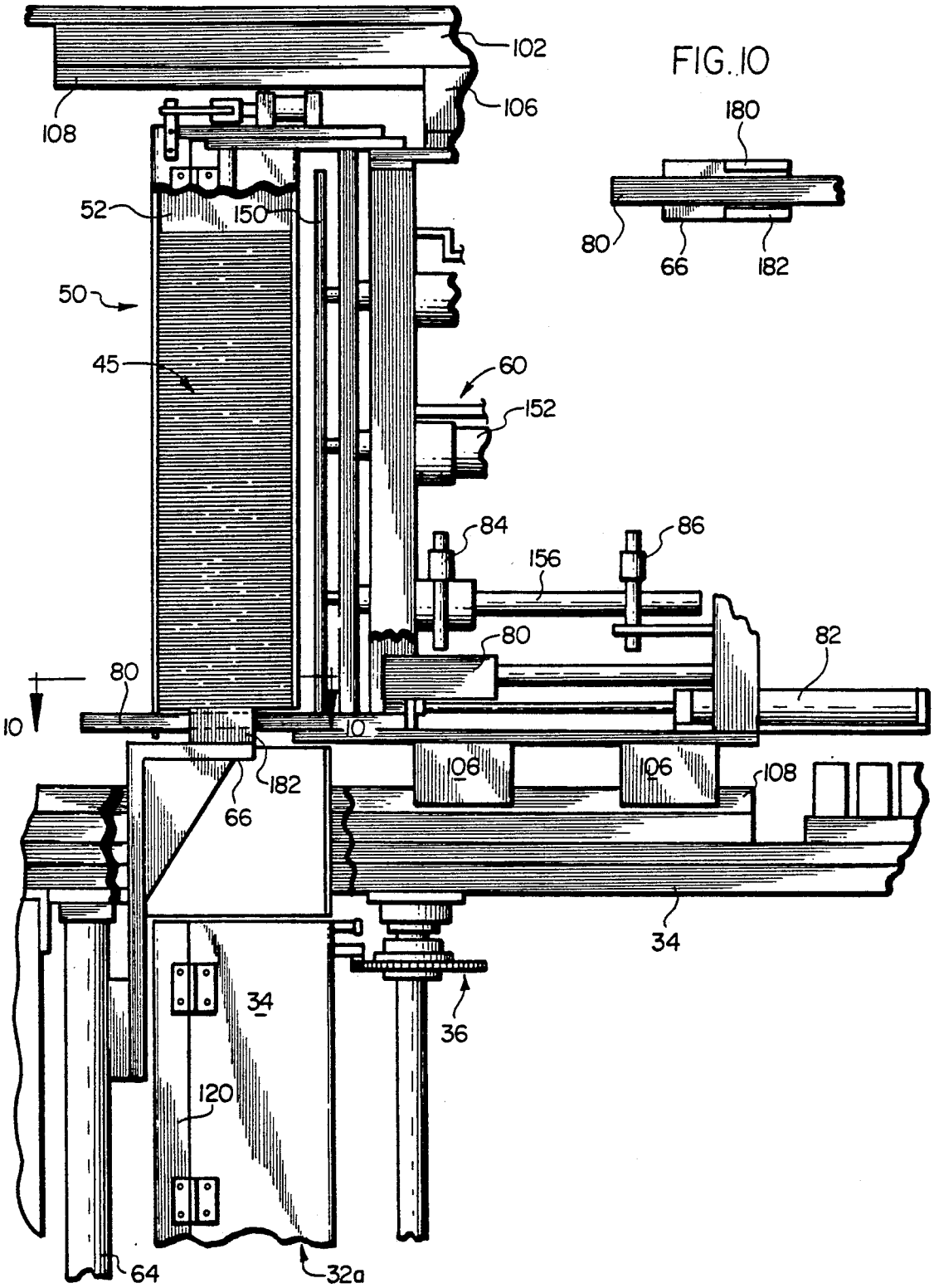
FIG. 9 is a further partial elevational view showing a further moved position of the apparatus.
FIG. 10 is a partial sectional view, taken along the line 10—10 of FIG. 9.

Referring briefly to FIG. 10, it will be seen that the shelf 80 interfits and extends through respective. raised block-like members 180, 182 of the lift arm 66. When the shelf has been fully extended for underlying and supporting the cartons, the lift member is withdrawn to its down position to permit the indexing of a succeeding supply pocket to the unloading station or position. This indexing may occur while the further transfer of last-received cartons to the outfeed pocket is in process, such that a filled supply pocket is in position and ready to be unloaded as soon as the loader pocket completes the transfer of cartons and retracts to its initial position.

Upon withdrawal of the lift arm 66, carriage drive cylinder 102 is actuated to move the entire carriage forward to position the loader pocket 52 in registry with outfeed pocket 42. Upon alignment of the two, an additional photosensor 190 is utilized to sense when the level of cartons in the outfeed pocket falls below the level of the shelf 94 thereof. It will be appreciated that only at this point can a new stack of cartons be accepted by the outfeed pocket.

Figure 11:
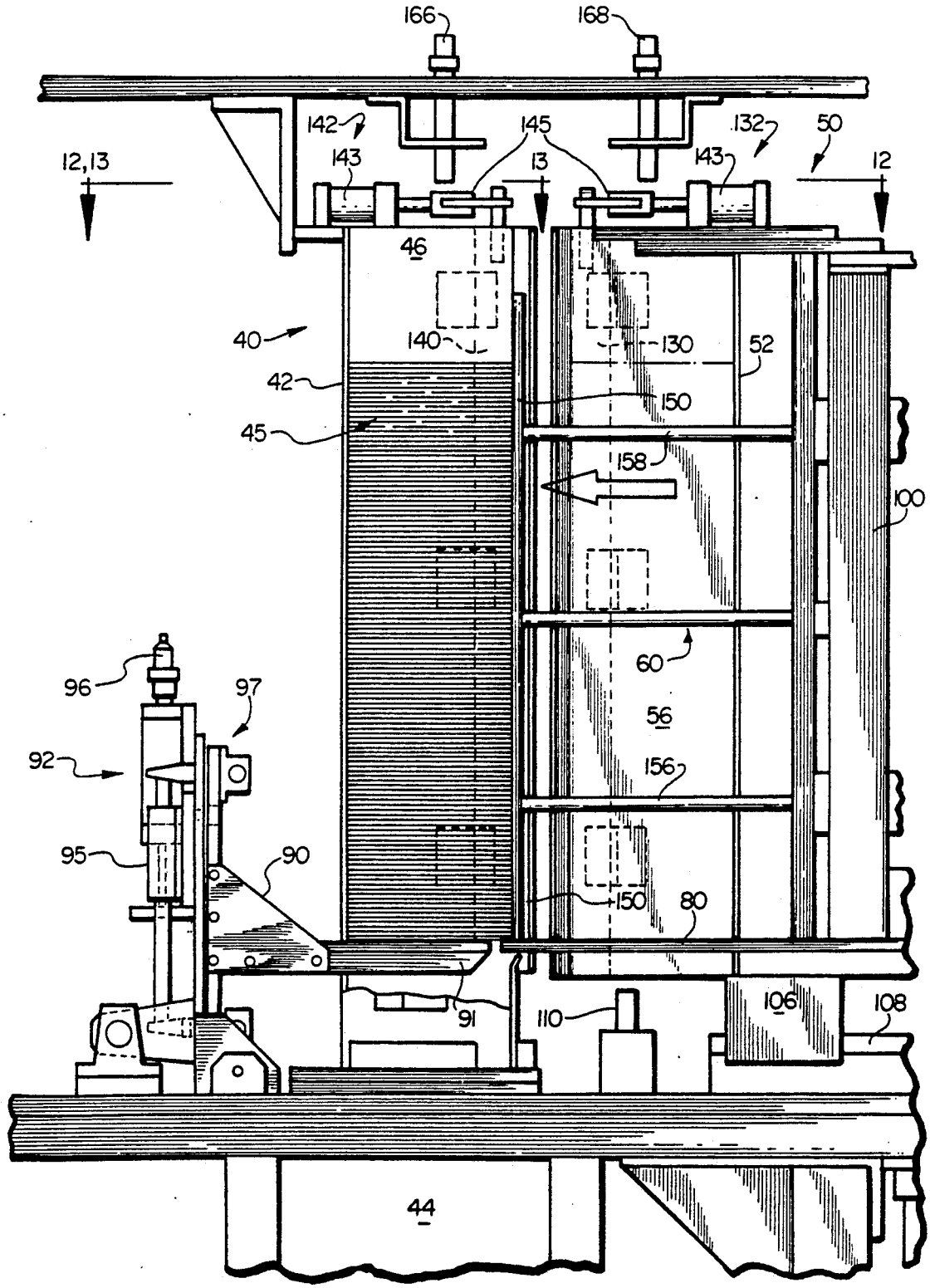
FIG. 11 is a partial side elevation of the apparatus of FIGS. 7-10, showing a further moved position thereof.
Figure 12:
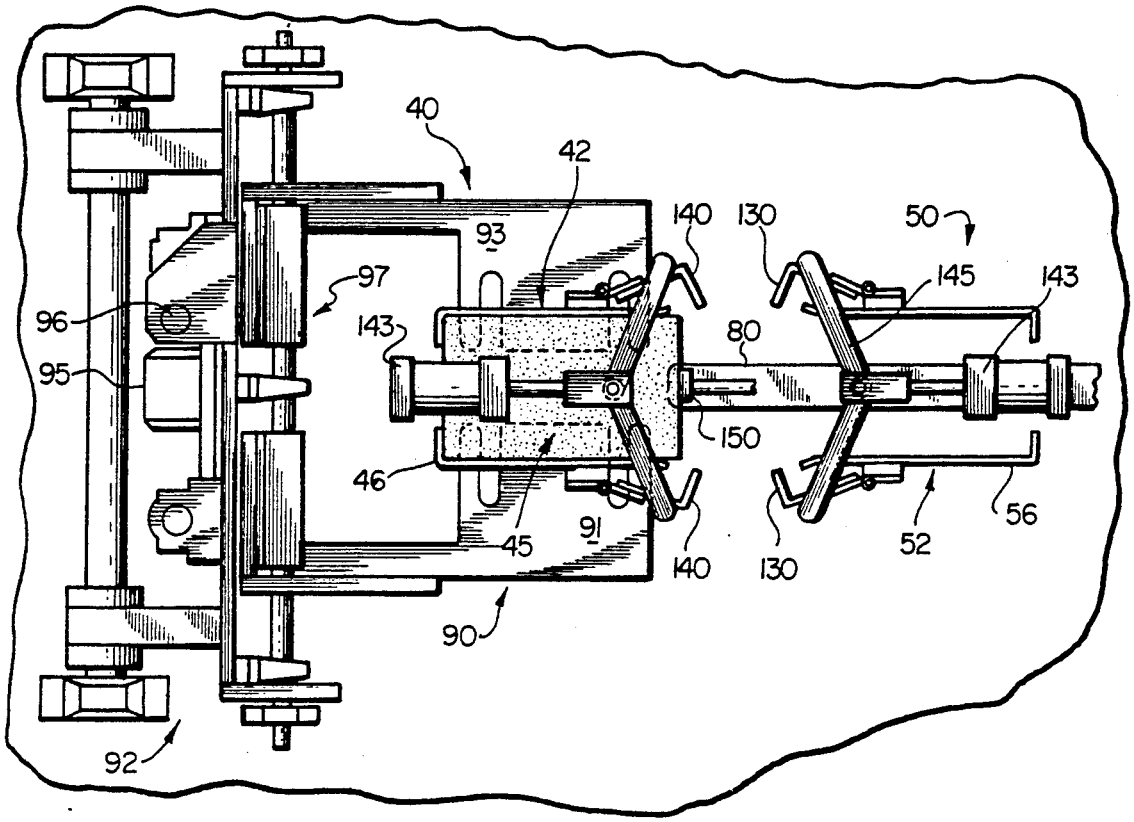
FIG. 12 is a view taken generally in the plane of the line 12—12 of FIG. 11.
Figure 13:
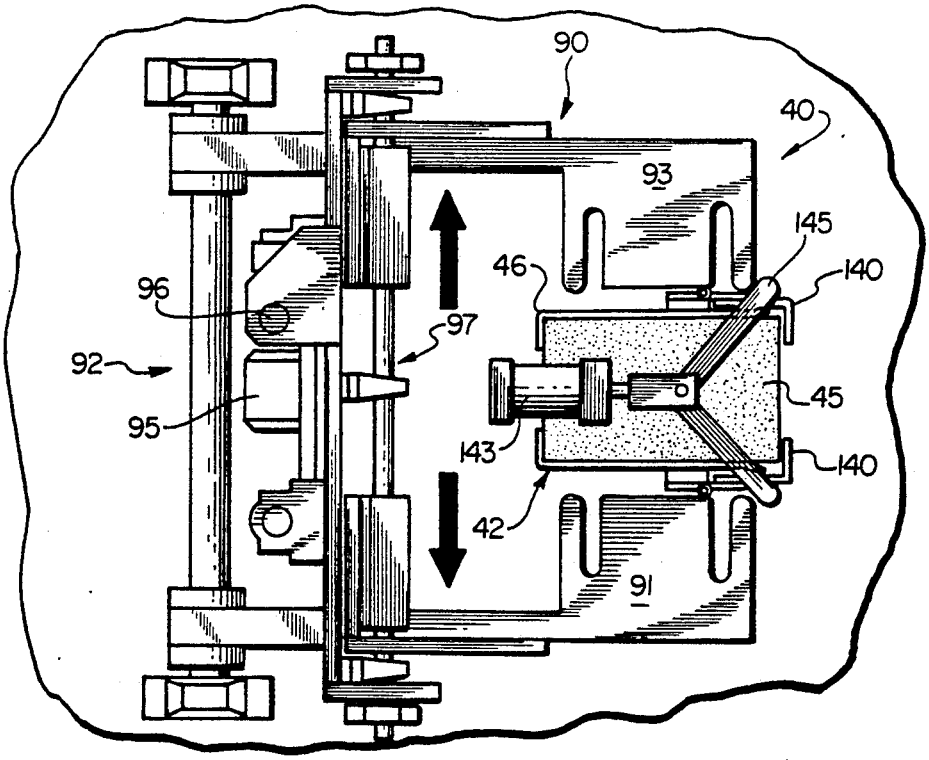
FIG. 13 is a view taken generally in the plane of the line 13—13 of FIG. 11 and showing a moved positon.

When sensor 190 verifies the level of cartons in the outfeed pocket to be below shelf 94, the control system 70 activates respective door control means or actuators 132, 142 to open the respective doors 130 and 140 to begin the transfer of cartons between the loader and outfeed pockets. Preferably each of these actuators 132 and 142 comprises a cylinder 143 and linkage assembly 145 operatively coupled with the hinged doors, as best viewed in FIG. 11. Thereupon the control cylinder 152 for the push bar 150 is actuated to effect the transfer of cartons. At the same time, the cylinder 95 for the outfeed shelf members 91, 93 is actuated to advance the shelves into the outfeed pocket to support the cartons as they are introduced thereto by the pusher bar 150. Operation of the pusher bar 150 will not be initiated until sensor 96 confirms the position of the supporting shelves 91, 93 in this regard.

When the pusher bar 150 has fully advanced to deposit the stack of cartons in outfeed pocket 42, it automatically begins a retracting motion, and the respective doors 130 and 140 are activated to their closed positions when the pusher bar has been retracted. Thereupon the shelves 91, 93 are also retracted to allow the newly introduced stack of cartons to freely enter the outlet chute 44 on top of the remaining cartons therein to provide continuous feed for the conveyor 20.

When these operations have taken place, the loader support shelf 80 is then retracted and the carriage 100 is actuated by cylinder 102 back to its initial position for placing the loader pocket in registry with a filled supply pocket 32 which has been moved or indexed into the unloading station or position in the interim. The entire process can now repeat with respect to a subsequent load of cartons carried in the newly indexed supply pocket 32.

Preferably, all of the above-described cylinders for actuating the various elements are pneumatically operated. However, electrically or hydraulically operated equipment may be used without departing from the invention.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. Carton feeding apparatus for delivering a stack of cartons from a supply pocket located below a receiving conveyor, said apparatus comprising: outfeed means for delivering cartons to said receiving conveyor; loader means movable between a first position in registry with said supply pocket and a second position in registry with said outfeed means for transporting a stack of cartons therebetween; lift means for lifting a stack of cartons from said supply pocket to said loader means; transfer means for transferring a stack of cartons from said loader means to said outfeed means, and control means for controlling a predetermined sequence of operation wherein successive stacks of cartons are initially lifted from said supply pocket to said loader means and thereafter transferred from said loader means to said outfeed means at a rate sufficient to assure a continuous supply of cartons to said receiving conveyor; wherein said supply pocket comprises an elongate, vertically-oriented, open-topped container having sidewalls and a bottom defining a cross-sectional configuration complementary with said collapsed cartons for accommodating a stack thereof, and means defining openings in one sidewall and said bottom for permitting entry and passage of said lift means for engaging and lifting said stack, and wherein said lift means comprises an elongate, vertically-oriented cylinder and an outwardly extending lift member coupled therewith, and said lift member being movable into registry with said openings defined in said supply pocket for entering the same and engaging and lifting said stack of cartons therein in response to a predetermined control signal from said control means.

2. Carton feeding apparatus for delivering a stack of cartons from a supply pocket located below a receiving conveyor, said apparatus comprising: outfeed means for delivering cartons to said receiving conveyor; loader means movable between a first position in registry with said supply pocket and a second position in registry with said outfeed means for transporting a stack of cartons therebetween; lift means for lifting a stack of cartons from said supply pocket to said loader means; transfer means for transferring a stack of cartons from said loader means to said outfeed means, and control means for controlling a predetermined sequence of operation wherein successive stacks of cartons are initially lifted from said supply pocket to said loader means and thereafter transferred from said loaded means to said outfeed means at a rate sufficient to assure a continuous supply of cartons to said receiving conveyor; wherein said loader means comprises an elongate, vertically-oriented, open-ended loader pocket having sidewalls defining a cross-sectional interior configuration complementary with said stack of cartons for accommodating a stack thereof, retractable loader shelf means movable into and out of said interior of said loader pocket for selectively underlying and supporting a stack of cartons therein, and shelf actuator means operatively coupled with said loader shelf means and responsive to a control signal from said control means for moving said loader shelf means into and out of position for supporting cartons in said loader pocket.

3. Apparatus according to claim 2 wherein said outfeed means comprise an elongate, vertically-oriented, open-ended outfeed pocket having sidewalls defining an interior cross-sectional configuration complementary with said collapsed cartons for accommodating a stack thereof and outfeed shelf means movable into and out of said interior of said outfeed pocket for selectively underlying and supporting a stack of cartons therein and shelf-actuator means operably coupled with said outfeed shelf means and responsive to a control signal from said control means for moving said outfeed shelf means into and out of position for supporting cartons in said outfeed pocket.

4. Apparatus according to claim 2 wherein said loader means further includes carriage means for bidirectionally transporting said loader pocket between a position in registry with said supply pocket to a position in registry with said outfeed pocket, and carriage actuator means responsive to a control signal from said control means for selectively actuating said carriage for movement of said loader pocket between said positions thereof in registry with said outfeed pocket and said supply pocket respectively.

5. Apparatus according to claim 2 wherein one of said sidewalls of said loader pocket is defined by hingedly movable door means and further including door actuator means operatively coupled with said door means and responsive to control signals from said control means for operating said door means between open and closed positions.

6. Apparatus according to claim 3 wherein one of said sidewalls of said outfeed pocket is defined by hingedly movable door means and further including door actuator means operatively coupled with said door means and responsive to control signals from said control means for operating said door means between open and closed positions.

7. Apparatus according to claim 3 wherein said transfer means includes pusher bar means located in registry with said loader pocket and movable into and through said loader pocket for contacting and pushing a stack of articles outwardly of said loader pocket and into said outfeed pocket when said loader pocket and said outfeed pocket are in registry, and pusher bar actuator means responsive to a control signal from said control means for actuating said pusher bar means for contacting, engaging and moving said stack of cartons from said loader pocket to said outfeed pocket.

8. Apparatus according to claim 7 wherein one of said sidewalls of said loader pocket is defined by hingedly movable door means and further including door actuator means operatively coupled with said door means and responsive to control signals from said control means for operating said door means between open and closed positions; and wherein said control means include sequencing means for controlling the operation of said pusher bar means and said doors in a predetermined sequence such that said doors open, said pusher bar means advances for engaging and discharging said cartons from said loader pocket, said pusher bar means retracts and said doors return to a closed position.

9. Apparatus according to claim 8, wherein one of said sidewalls of said outfeed pocket is defined by hingedly movable door means and further including door actuator means operatively coupled with said door means and responsive to control signals from said control means for operating said door means between open and closed positions and wherein said sequencing means further controls operation of said outfeed pocket doors and said outfeed shelf means such that said outfeed pocket doors open and said outfeed shelf means enters said outfeed pocket substantially simultaneously with the opening of said loader pocket doors and such that said outfeed pocket doors close upon retraction of said pusher bar means and said outfeed shelf means retracts from said outfeed pocket upon closing of said doors to permit said cartons to freely feed downwardly through said outfeed pocket to said conveyor.

10. Apparatus according to claim 2 wherein said loader shelf means and said lift means have complementary interfitting carton supporting surfaces, such that said shelf means can extend into and through said lift means for engaging and supporting said cartons when said lift means is fully vertically advanced relative to said loader means, and such that said lift means can be retracted upon engagement of said cartons by said shelf means, and further including sensor means for producing a sensor signal when said shelf means is advanced for engagement with said cartons, said control means being responsive to said sensor for producing a control signal for causing said lift means to retract.

11. Apparatus according to claim 7 and further including sensor means for detecting the level of cartons at said outfeed pocket and for producing a sensor signal corresponding to said level being below a predetermined level and said control means being responsive to said sensor signal for producing a control signal for actuating said pusher bar means to initiate the transfer of cartons from said loader pocket to said outfeed pocket.

12. Apparatus according to claim 8 and further including sensor means for determining the relative positions of said pusher bar means and said doors for producing corresponding sensor signals for use by said control means in producing control signals to control the sequence of actuation thereof.

13. Apparatus according to claim 9 and further including sensor means for producing sensor signals corresponding to the positions of said pusher bar means, said outfeed pocket doors and said outfeed shelf means for use by said control means in producing control signals to control the sequence of operation thereof.

14. Apparatus according to claim 4 and further including sensor means for producing sensor signals corresponding to the relative positions of said carriage means, said loader shelf means and said lift means for use by said control means in producing control signals to control the sequence of operation thereof.

15. Carton feeding apparatus for delivering a stack of cartons from a supply pocket located below a receiving conveyor, said apparatus comprising: outfeed means for delivering cartons to said receiving conveyor; loader means movable between a first position in registry with said supply pocket and a second position in registry with said outfeed means for transporting a stack of cartons therebetween; lift means for lifting a stack of cartons from said supply pocket to said loader means; transfer means for transferring a stack of cartons from said loader means to said outfeed means, and control means for controlling a predetermined sequence of operation wherein successive stacks of cartons are initially lifted from said supply pocket to said loader means and thereafter transferred from said loader means to said outfeed means at a rate sufficient to assure a continuous supply of cartons to said receiving conveyor; and further including a carousel-type infeed device including a plurality of supply pockets rotatable about a frame and drive means for indexing said supply pockets about said frame, such that supply pockets are rotated into registry with said lift means in a sequential fashion.

16. Apparatus according to claim 15 and further including clamping means for grippingly engaging the supply pocket in registry with said lift means to stabilize the same during operation of said lift means to remove a stack of cartons therefrom.

17. Apparatus according to claim 15 and further including sensor means for determining the presence or absence of a stack of cartons in the supply pocket in registry with said lift means and for producing a control signal to cause indexing of a further supply pocket when said supply pocket in registry with the lift means is empty.

18. Apparatus for providing a continuous supply of cartons to an infeed device of a carton utilization apparatus comprising: a carousel-type supply unit including a plurality of supply pockets each for receiving a stack of cartons and drive means for rotating said supply pockets in sequence into registry with a given location, and carton feeding apparatus having loader means locatable in registry with said given location for receiving cartons from said supply pocket, said carton feeding apparatus being arranged to remove cartons from said supply pocket of said carousel and deliver the same to said infeed device of said carton utilization apparatus, said infeed device being located such that the bottom of a stack of cartons delivered thereto is at a level higher than the bottom of a stack of cartons located in said supply pocket, said carton feeding apparatus comprising outfeed means located for delivering cartons to said infeed device; said loader means being movable between a first position in registry with said supply pocket and a second position in registry with said outfeed means for transporting a stack of cartons therebetween; lift means for lifting a stack of cartons from said supply pocket to said loader means; transfer means for transferring a stack of cartons from said loader means to said outfeed means, and control means for controlling a predetermined sequence of operation wherein successive stacks of cartons are initially lifted from said supply pocket to said loader means and thereafter transferred from said loader means to said outfeed means at a rate sufficient to assure a continuous supply of cartons to said infeed device.

* * * * *